United States Patent [19]

Floros

[11] Patent Number: 4,951,439

[45] Date of Patent: Aug. 28, 1990

[54] INNER WALL TO AN OUTER WALL IN A WALL CONSTRUCTION

[76] Inventor: Constantinos Floros, 7475 Madrid St., Brossard, Canada, J4Y 1G1

[21] Appl. No.: 294,747

[22] Filed: Jan. 9, 1989

[51] Int. Cl.[5] ..... E04B 2/28

[52] U.S. Cl. ..... 52/351; 52/370; 52/714

[58] Field of Search ..... 52/712, 714, 344–352, 52/370–373, 432, 433, 562, 713

[56] References Cited

U.S. PATENT DOCUMENTS

| | | | |
|---|---|---|---|
| 656,365 | 8/1900 | McDowell | 52/373 |
| 1,118,806 | 11/1914 | Reid | 52/370 |
| 1,803,141 | 4/1931 | Paulissen | 52/370 |
| 1,930,981 | 10/1933 | Miller | 52/351 |
| 2,309,420 | 1/1943 | Taylor | 52/351 |

*Primary Examiner*—James L. Ridgill, Jr.

[57] ABSTRACT

A rigid attachment to spacedly secure an inner drywall to an outer wall, made of building blocks, such as concrete blocks. Each attachment is formed of a first arm and a second arm normal thereto. The first arm is provided with lateral projections to anchor the first arm in mortar between the building blocks. Abutments are further provided to firmly position the second arm in parallel, spaced-apart relationship to the outer wall. The attachment may be used vertically, or horizontally, in the outer wall.

4 Claims, 3 Drawing Sheets

INNER WALL TO AN OUTER WALL IN A WALL CONSTRUCTION

FIELD OF THE INVENTION

The present invention relates to wall construction, more specifically to an attachment adapted to fix an inner wall in permanent spaced-apart relation to an outer wall.

BACKGROUND OF THE INVENTION

Inner walls consisting of, for example, dry wall panels, are secured to outer walls made of concrete block, bricks, or stones. Till now, it was necessary to first secure furring or strips to the outer wall by the use of nails explosively shot through the furring and into the outer wall and then to nail or screw the dry wall panels to the furring. The furring leaves room for insulation between the two walls. However, use of explosively-shot nails is expensive and requires a special gun.

OBJECTS OF THE INVENTION

In view of the above, it is a first object of the present invention to provide an attachment member which obviates the above-mentioned disadvantages.

It is another object of the present invention to provide a member of the above type, which is easily and quickly secured to the outer wall and which is not costly to produce.

SUMMARY OF THE INVENTION

The above and other objects and advantages of the present invention are realized according to a preferred embodiment comprising a rigid generally L-shaped plate which is adapted to be permanently embedded in the mortar between the units, such as concrete blocks, of which the outer wall is composed. Most of one arm of the L-shape is so embedded. The other arm of the plate project interiorly of the inner face of the outer wall and parallel to the latter. Such other arm is also spaced away from the outer wall at a predetermined distance by outer wall abutment means carried by the attachment.

A mortar anchoring means is embodied by a bent portion of the first-mentioned arm of the plate and/or by holes made therein.

The outer wall-abutment means may be provided on the first or on the second arm.

It will be clear that once the mortar has set, a panel of an inner wall may be easily fastened to the second-mentioned arm of the plate by metal screws or the like.

According to another embodiment of the invention, there is provided a pair of closely-spaced parallel arms also, as in the above-described embodiment, adapted to be disposed in the mortar between the building units of the outer wall.

The two arms are also provided with mortar anchoring means. Interiorly of the outer wall, these two arms merge with integrally-formed flanges defining a general box-shape. The flanges include outer sides, lateral sides and an inner side. Inner wall panels may thus be secured to the box-shape. The lateral portions of the latter may be of varying dimensions, so that insulating material of varying thicknesses will fit between the inner and outer walls.

It is within the scope of the invention to utilize each of the embodiments of the attachment in two different ways; firstly the attachment can be inserted vertically between building units in aligned columns. In such application, the width, i.e. the vertical dimension of the two arms, is equal and corresponds to the height of a building unit. Secondly, the attachment can be disposed horizontally, so that the first-mentioned arm, or arms extend in the mortar between rows of building units and each attachment is as long as a selected plurality of the latter.

BRIEF DESCRIPTION OF THE DRAWINGS

The above will be more clearly understood by having referral to the preferred embodiments of the invention, illustrated by way of the accompanying drawings, in which.

Like numerals indicate like elements throughout the drawings.

DESCRIPTION OF THE PREFERRED EMBODIMENTS

Figure 4:
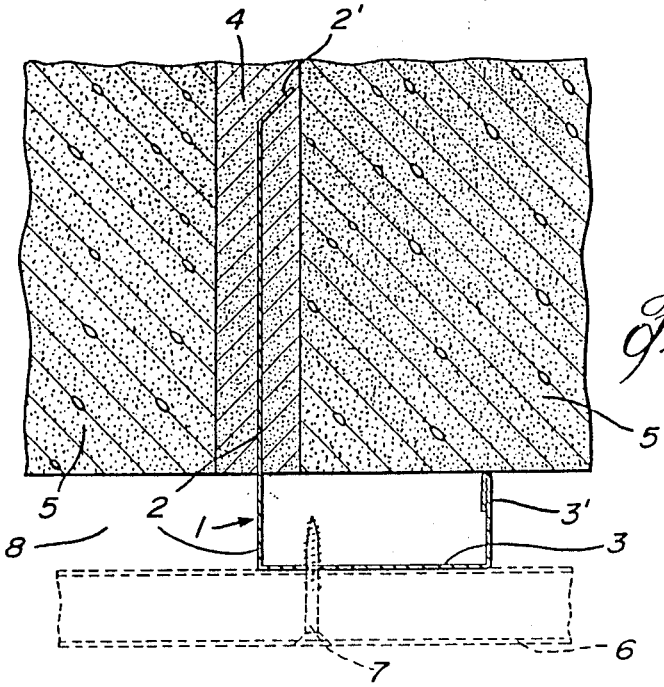
FIG. 4 is another sectional view identical to that of FIG. 2, showing a second preferred embodiment according to the invention and an inner wall panel in dashed outline.

Referring firstly to FIG. 4, there is shown a preferred embodiment of the invention, consisting of a rigid metal L-shaped plate 1. Plate 1 includes a first arm 2 and a second arm 3, which is normal to the first arm. The outer end of arm 2 is bent angularly at 2' to prevent the plate from being transversely dislocated in mortar before and after the latter has set. Serving the same function are, preferably, holes 12 adjacent flange 2' (cf FIG. 6). The holes and flange 2' thus constitute the mortar anchoring means for arm 2.

Plate 1 is further provided with an outer wall abutment means consisting of an outwardly (transversely) bent end portion 3' of arm 3, such portion having an end edge which contacts the inner surface of a building unit 5 (The units depicted are concrete blocks).

An inner dry wall panel 6 is also shown in FIG. 4. Panel 6 is simply fixed to arm 3 by metal screws 7, thereby defining a space 8 which may or may not be filled with insulation.

Figure 5:
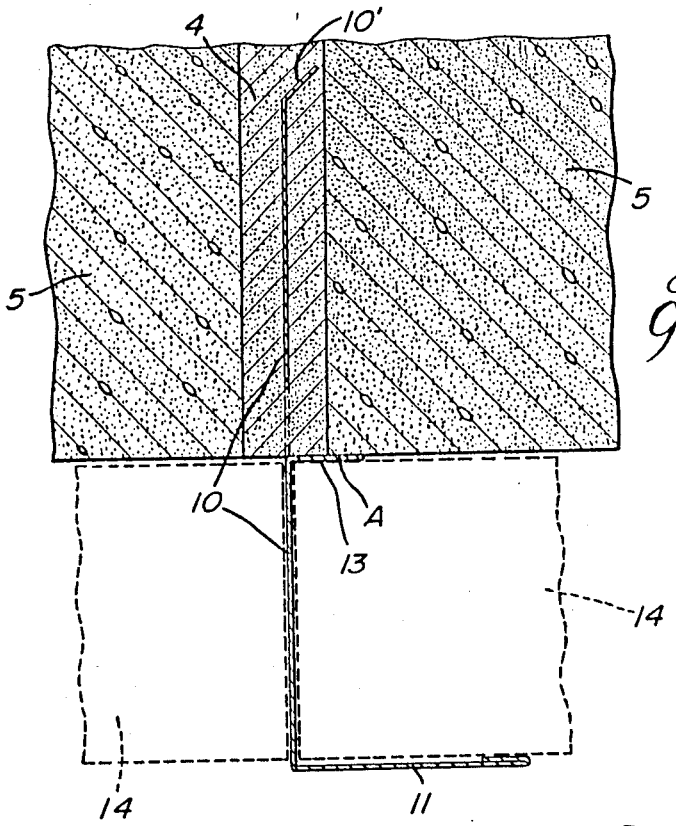
FIG. 5 is still another sectional view identical to the view of FIG. 2 but showing a third embodiment provided with a variation of an outer wall abutment means.
Figure 6:
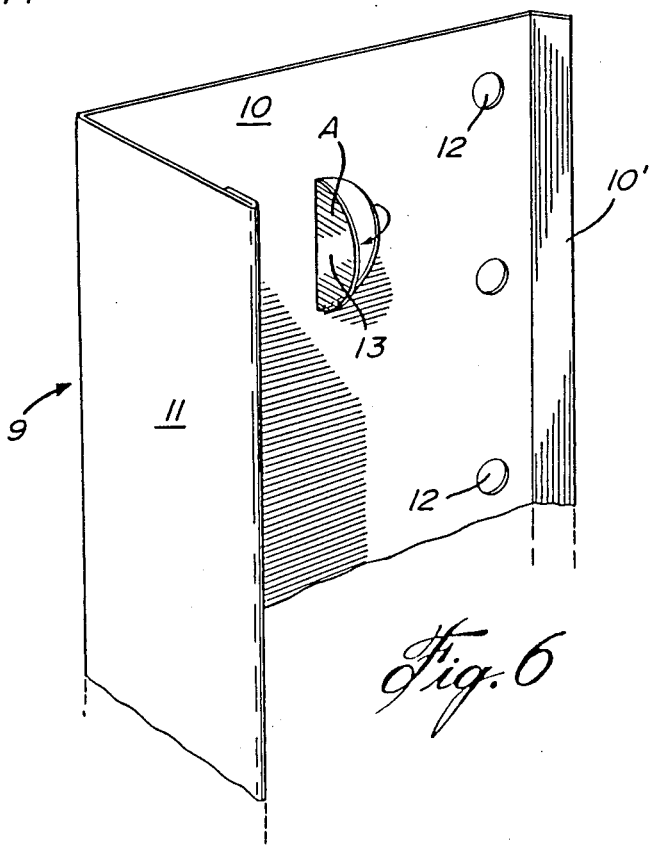
FIG. 6 is a perspective view of the attachment plate of FIG. 4.

FIGS. 5 and 6 represent a variation of the preferred embodiment of FIG. 4. Plate 9 is similar to plate 1 in that it has a first arm 10 and a right angular second arm il. Arm 1 is also bent angularly at its outer end 10' and has spaced-apart holes 12, as in the embodiment of FIG. 4, thus constituting the same mortar anchoring means.

The outer wall abutment means is, however, differently envisioned. It consists of a semi circular struck-out tab !3 in arm 10, extending parallel to second arm 11. Tab !3 is shown in FIG. 5 as abutting against the inner surface of a concrete block 5 to positively maintain arm 11 at the required constant distance from block 5.

The above-described variation of the embodiment of FIG. 4 is shown in FIG. 5 as retaining relatively thick insulation 14. It will be clear that in both embodiments, the transverse length of first arms 2 and 10 and also the length of second arms 3 and 11 may be varied as needed.

Figure 2:
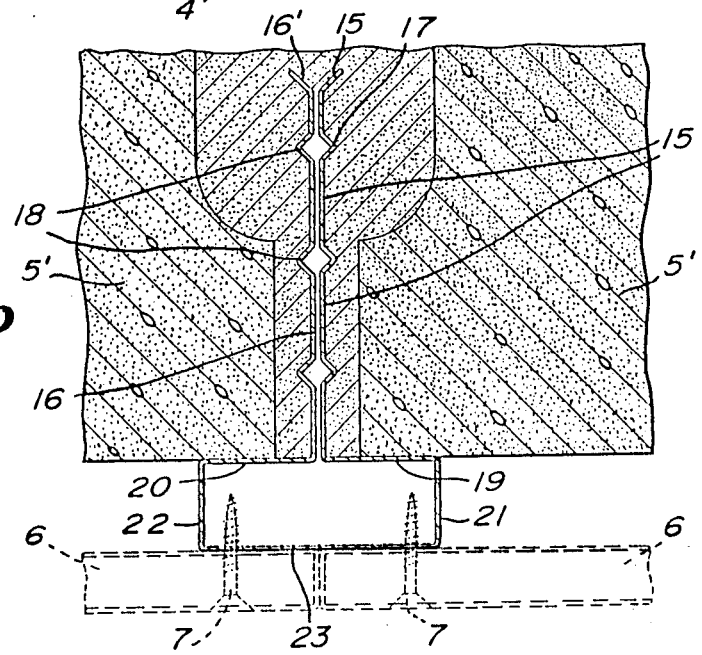
FIG. 2 is a cross-sectional view taken along lines 2—2 of FIG. 1, showing a first embodiment of the attachment.
Figure 3:
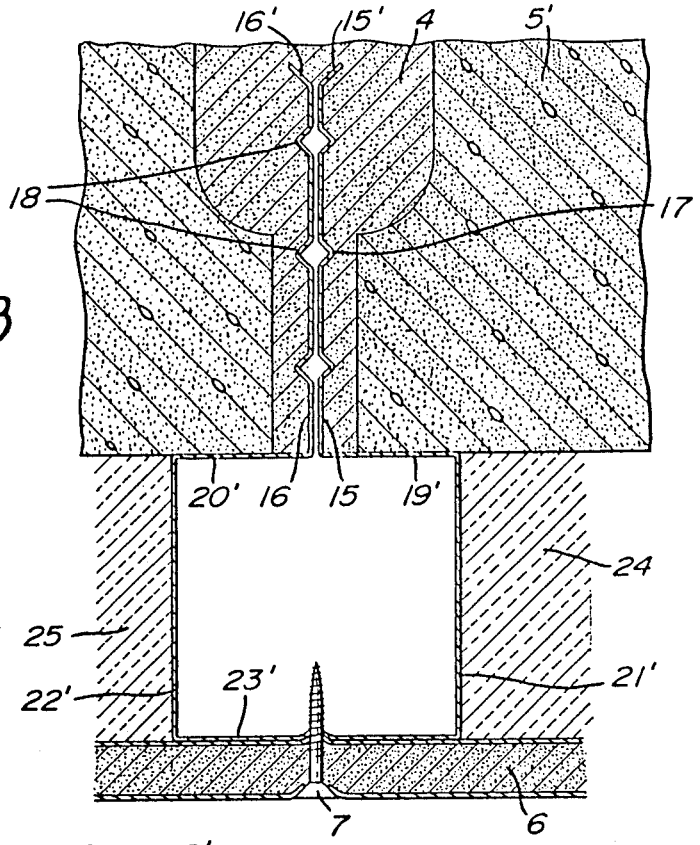
FIG. 3 is a sectional view identical to that of FIG. 2 but showing a longer set of box-shaped flanges and an inner wall panel affixed thereto, further showing insulation in place between the two walls.

Referring now to FIGS. 2 and 3, there is shown an embodiment of the invention and another variation, respectively.

Such embodiment is comprised of a pair of closely-spaced parallel arms 15 and 16. Each arm 15 and 16 has an angular outer end, indicated at 15' 16'. Each arm is further formed with a plurality of spaced-apart ridges 17, 18 which together define a cross-sectional diamond-shape. The ends 15' 16', along with ridges 17, 18, constitute the mortar anchoring means for this embodiment.

Instead of a second arm, the attachment according to the first embodiment is provided with integrally-formed outer wall-abutting flanges 19, 20, lateral flanges 21, 22 and an inner wall-abutting flange 23. Pairs of screws 7 are used to secure a pair of dry wall panels 6 to flange 23. The building units 5', shown in FIGS. 2 and 3, are also concrete blocks of the type having central empty spaces, in this case filled by mortar.

As noted above and suggested in FIG. 3, at least the lateral (transverse). and preferably the other dimensions of the box-shape flanges, may be varied as needed. Thus, thick insulation panel 24. 25 may be provided on either side of the lateral flanges 21' 22'.

Figure 1:
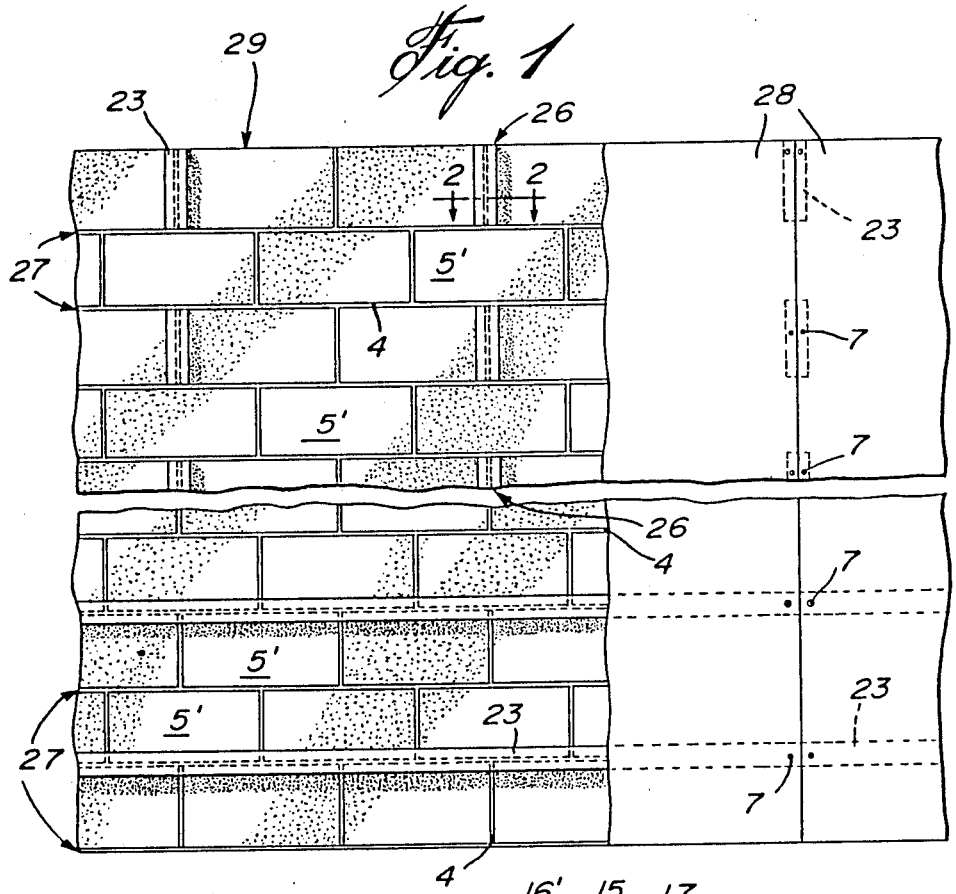
FIG. 1 is an elevation view of two portions of the inner surface of an inner wall and broken away at the left to show an outer wall, the upper portion being provided with the attachment of the invention according to a first vertical application, and the lower portion being provided with the attachment in a horizontal second application.

Referring finally to FIG. 1, there are shown two applications of the invention. Firstly, the upper portion of the drawing illustrates the attachment disposed in vertically-aligned columns 26 in every second horizontal row 27 of the building units. The vertical dimension of the pair of each attachment is equal to the height of each building unit. (If the second or third embodiment is used, the two arms are of equal vertical dimension, i.e. width). If either one of the embodiments of FIG. 2 and 3 is used, the box-shaped flanges are also of the same width as the pair of arms.

The lower portion of FIG. 1 illustrates a second application of the attachment, wherein the attachment of any embodiment may be disposed in the mortar of horizontal rows 27 between the building units. According to this use, the attachment may be elongated to correspond in length to a plurality of building unit lengths, as shown.

The embodiments of FIGS. 4 and 5 are preferred over the other embodiments, because: (a) they are less costly to produce by virtue of the facts that less metal is required; and (b) the shape is simpler.

What I claim is:

1. An attachment to secure an inner wall to an outer wall, the inner wall consisting of dry-wall panels and the outer wall being composed of building units held together by mortar; the attachment comprising: a rigid, elongated, one-piece, sheet metal strip of L-shaped cross-section, including one arm having an outer portion and an inner portion, said one arm outer portion adapted to be permanently embedded in the mortar between selected building unit; mortar anchoring means integral with said one arm outer portion to secure said one arm in said mortar; said one arm inner portion adapted to protrude inwardly from said outer wall; and another arm connected to an normal to said one arm; adapted to project parallel to and spaced apart from the inner surface of the outer wall; said other arm being im perforate and forming a dry wall panel backing and a metal screw receiving sheet member; and an outer wall abutment means integral with said strip to maintain said other arm in such position, whereby inner dry wall panels may be secured by metal screws to said other arm.

2. An attachment as defined in claim 1, wherein said mortar anchoring means consists of said one arm outer portion being provided with an angularly-bent outer end; and a plurality of holes in said one arm outer portion adjacent said bent outer end.

3. An attachment as defined in claim 1, wherein said abutment means consists of said other arm being provided with an outwardly-bent end portion adapted to abut the inner surface of the outer wall.

4. An attachment as defined in claim 1, wherein said abutment means consists of said one arm being provided with a struck-out tab extending parallel to said other arm; said tab being adapted to abut the inner surface of said outer wall, a space being defined between said tab and said other arm adapted to receive and retain the marginal portion of an insulation panel the edge of which abuts against said one arm.

* * * * *